US008068068B2

(12) United States Patent
Kish et al.

(10) Patent No.: US 8,068,068 B2
(45) Date of Patent: Nov. 29, 2011

(54) COVERAGE ANTENNA APPARATUS WITH SELECTABLE HORIZONTAL AND VERTICAL POLARIZATION ELEMENTS

(75) Inventors: William Kish, Mountain View, CA (US); Victor Shtrom, Mountain View, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 650 days.

(21) Appl. No.: 12/082,090

(22) Filed: Apr. 7, 2008

(65) Prior Publication Data

US 2008/0291098 A1 Nov. 27, 2008

Related U.S. Application Data

(63) Continuation of application No. 11/413,461, filed on Apr. 28, 2006, now Pat. No. 7,358,912.

(60) Provisional application No. 60/694,101, filed on Jun. 24, 2005.

(51) Int. Cl.
*H01Q 3/24* (2006.01)

(52) U.S. Cl. ..... 343/876; 343/893

(58) Field of Classification Search ..... 343/700 MS, 343/793, 795, 846, 876, 893
See application file for complete search history.

(56) References Cited

U.S. PATENT DOCUMENTS

| | | | |
|---|---|---|---|
| 723,188 | A | 3/1903 | Tesla |
| 725,605 | A | 4/1903 | Tesla |
| 1,869,659 | A | 8/1932 | Broertjes |
| 2,292,387 | A | 8/1942 | Markey et al. |
| 3,488,445 | A | 1/1970 | Chang |
| 3,568,105 | A | 3/1971 | Felsenheld |
| 3,887,925 | A | 6/1975 | Ranghelli |
| 3,967,067 | A | 6/1976 | Potter |
| 3,982,214 | A | 9/1976 | Burns |
| 3,991,273 | A | 11/1976 | Mathes |
| 4,001,734 | A | 1/1977 | Burns |
| 4,027,307 | A | 5/1977 | Litchford |
| 4,176,356 | A | 11/1979 | Foster et al. |
| 4,193,077 | A | 3/1980 | Greenberg et al. |
| 4,203,118 | A | 5/1980 | Alford |
| 4,253,193 | A | 2/1981 | Kennard |
| 4,305,052 | A | 12/1981 | Baril et al. |

(Continued)

FOREIGN PATENT DOCUMENTS

DE 102006026350 A1 12/2006

(Continued)

OTHER PUBLICATIONS

Tsunekawa, Kouichi, "Diversity Antennas for Portable Telephones," 39th IEEE Vehicular Technology Conference, pp. 50-56, vol. I, Gateway to New Concepts in Vehicular Technology, May 1-3, 1989, San Francisco, CA.

(Continued)

*Primary Examiner* — Hoang V Nguyen
(74) *Attorney, Agent, or Firm* — Lewis and Roca LLP

(57) ABSTRACT

An antenna apparatus comprises selectable antenna elements including a plurality of dipoles and/or a plurality of slot antennas ("slot"). Each dipole and/or each slot provides gain with respect to isotropic. The dipoles may generate vertically polarized radiation and the slots may generate horizontally polarized radiation. Each antenna element may have one or more loading structures configured to decrease the footprint (i.e., the physical dimension) of the antenna element and minimize the size of the antenna apparatus.

18 Claims, 7 Drawing Sheets

U.S. PATENT DOCUMENTS

| | | | |
|---|---|---|---|
| 4,513,412 | A | 4/1985 | Cox |
| 4,554,554 | A | 11/1985 | Olesen |
| 4,733,203 | A | 3/1988 | Ayasli |
| 4,814,777 | A | 3/1989 | Monser |
| 4,821,040 | A | 4/1989 | Johnson et al. |
| 5,063,574 | A | 11/1991 | Moose |
| 5,097,484 | A | 3/1992 | Akaiwa |
| 5,173,711 | A | 12/1992 | Takeuchi et al. |
| 5,203,010 | A | 4/1993 | Felix |
| 5,208,564 | A | 5/1993 | Burns et al. |
| 5,220,340 | A | 6/1993 | Shafai |
| 5,282,222 | A | 1/1994 | Fattouche et al. |
| 5,291,289 | A | 3/1994 | Hulyalkar et al. |
| 5,311,550 | A | 5/1994 | Fouche et al. |
| 5,373,548 | A | 12/1994 | McCarthy |
| 5,434,575 | A | 7/1995 | Jelinek |
| 5,479,176 | A | 12/1995 | Zavrel |
| 5,507,035 | A | 4/1996 | Bantz |
| 5,532,708 | A | 7/1996 | Krenz |
| 5,559,800 | A | 9/1996 | Mousseau et al. |
| 5,726,666 | A | 3/1998 | Hoover et al. |
| 5,754,145 | A | 5/1998 | Evans |
| 5,767,755 | A | 6/1998 | Kim |
| 5,767,807 | A | 6/1998 | Pritchett |
| 5,767,809 | A | 6/1998 | Chuang et al. |
| 5,786,793 | A | 7/1998 | Maeda |
| 5,802,312 | A | 9/1998 | Lazaridis et al. |
| 5,828,346 | A | 10/1998 | Park |
| 5,936,595 | A | 8/1999 | Wang |
| 5,964,830 | A | 10/1999 | Durrett |
| 5,990,838 | A | 11/1999 | Burns |
| 6,005,525 | A | 12/1999 | Kivela |
| 6,011,450 | A | 1/2000 | Miya |
| 6,031,503 | A | 2/2000 | Preiss, II |
| 6,034,638 | A | 3/2000 | Thiel et al. |
| 6,052,093 | A | 4/2000 | Yao |
| 6,091,364 | A | 7/2000 | Murakami |
| 6,094,177 | A | 7/2000 | Yamamoto |
| 6,097,347 | A | 8/2000 | Duan |
| 6,104,356 | A | 8/2000 | Hikuma |
| 6,169,523 | B1 | 1/2001 | Ploussios |
| 6,266,528 | B1 | 7/2001 | Farzaneh |
| 6,288,682 | B1 | 9/2001 | Thiel |
| 6,292,153 | B1 | 9/2001 | Aiello et al. |
| 6,307,524 | B1 | 10/2001 | Britain |
| 6,317,599 | B1 | 11/2001 | Rappaport et al. |
| 6,323,810 | B1 | 11/2001 | Poilasne |
| 6,326,922 | B1 | 12/2001 | Hegendoerfer |
| 6,337,628 | B2 | 1/2002 | Campana, Jr. |
| 6,337,668 | B1 | 1/2002 | Ito et al. |
| 6,339,404 | B1 | 1/2002 | Johnson |
| 6,345,043 | B1 | 2/2002 | Hsu |
| 6,356,242 | B1 | 3/2002 | Ploussios |
| 6,356,243 | B1 | 3/2002 | Schneider et al. |
| 6,356,905 | B1 | 3/2002 | Gershman et al. |
| 6,377,227 | B1 | 4/2002 | Zhu et al. |
| 6,392,610 | B1 | 5/2002 | Braun et al. |
| 6,404,386 | B1 | 6/2002 | Proctor, Jr. et al. |
| 6,407,719 | B1 | 6/2002 | Ohira et al. |
| RE37,802 | E | 7/2002 | Fattouche et al. |
| 6,414,647 | B1 | 7/2002 | Lee |
| 6,424,311 | B1 | 7/2002 | Tsai |
| 6,442,507 | B1 | 8/2002 | Skidmore et al. |
| 6,445,688 | B1 | 9/2002 | Garces et al. |
| 6,456,242 | B1 | 9/2002 | Crawford |
| 6,493,679 | B1 | 12/2002 | Rappaport et al. |
| 6,496,083 | B1 | 12/2002 | Kushitani et al. |
| 6,498,589 | B1 | 12/2002 | Horii |
| 6,499,006 | B1 | 12/2002 | Rappaport et al. |
| 6,507,321 | B2 | 1/2003 | Oberschmidt et al. |
| 6,521,422 | B1 | 2/2003 | Hsu |
| 6,531,985 | B1 | 3/2003 | Jones |
| 6,583,765 | B1 | 6/2003 | Schamberger |
| 6,586,786 | B2 | 7/2003 | Kitazawa et al. |
| 6,606,059 | B1 | 8/2003 | Barabash |
| 6,611,230 | B2 | 8/2003 | Phelan |
| 6,621,029 | B2 | 9/2003 | Galmiche |
| 6,625,454 | B1 | 9/2003 | Rappaport et al. |
| 6,633,206 | B1 | 10/2003 | Kato |
| 6,642,889 | B1 | 11/2003 | McGrath |
| 6,642,890 | B1 | 11/2003 | Chen |
| 6,674,459 | B2 | 1/2004 | Ben-Shachar et al. |
| 6,701,522 | B1 | 3/2004 | Rubin et al. |
| 6,724,346 | B2 | 4/2004 | Le Bolzer |
| 6,725,281 | B1 | 4/2004 | Zintel et al. |
| 6,741,219 | B2 | 5/2004 | Shor |
| 6,747,605 | B2 | 6/2004 | Lebaric |
| 6,753,814 | B2 | 6/2004 | Killen et al. |
| 6,757,267 | B1 | 6/2004 | Evans |
| 6,762,723 | B2 | 7/2004 | Nallo et al. |
| 6,779,004 | B1 | 8/2004 | Zintel |
| 6,819,287 | B2 | 11/2004 | Sullivan et al. |
| 6,839,038 | B2 | 1/2005 | Weinstein |
| 6,859,176 | B2 | 2/2005 | Choi |
| 6,859,182 | B2 | 2/2005 | Horii |
| 6,876,280 | B2 | 4/2005 | Nakano |
| 6,876,836 | B2 | 4/2005 | Lin |
| 6,888,504 | B2 | 5/2005 | Chiang |
| 6,888,893 | B2 | 5/2005 | Li et al. |
| 6,892,230 | B1 | 5/2005 | Gu et al. |
| 6,894,653 | B2 | 5/2005 | Chiang |
| 6,903,686 | B2 | 6/2005 | Vance et al. |
| 6,906,678 | B2 | 6/2005 | Chen |
| 6,910,068 | B2 | 6/2005 | Zintel et al. |
| 6,914,581 | B1 | 7/2005 | Popek |
| 6,924,768 | B2 | 8/2005 | Wu et al. |
| 6,931,429 | B2 | 8/2005 | Gouge et al. |
| 6,941,143 | B2 | 9/2005 | Mathur |
| 6,943,749 | B2 | 9/2005 | Paun |
| 6,950,019 | B2 | 9/2005 | Bellone et al. |
| 6,950,069 | B2 | 9/2005 | Gaucher |
| 6,961,028 | B2 | 11/2005 | Joy et al. |
| 6,965,353 | B2 | 11/2005 | Shirosaka et al. |
| 6,973,622 | B1 | 12/2005 | Rappaport et al. |
| 6,975,834 | B1 | 12/2005 | Forster |
| 6,980,782 | B1 | 12/2005 | Braun et al. |
| 7,023,909 | B1 | 4/2006 | Adams et al. |
| 7,034,769 | B2 | 4/2006 | Surducan |
| 7,034,770 | B2 | 4/2006 | Yang et al. |
| 7,043,277 | B1 | 5/2006 | Pfister |
| 7,050,809 | B2 | 5/2006 | Lim |
| 7,053,844 | B2 | 5/2006 | Gaucher |
| 7,064,717 | B2 | 6/2006 | Kaluzni et al. |
| 7,085,814 | B1 | 8/2006 | Ghandi et al. |
| 7,088,299 | B2 | 8/2006 | Siegler et al. |
| 7,089,307 | B2 | 8/2006 | Zintel et al. |
| D530,325 | S | 10/2006 | Kerila |
| 7,130,895 | B2 | 10/2006 | Zintel et al. |
| 7,164,380 | B2 | 1/2007 | Saito |
| 7,171,475 | B2 | 1/2007 | Weisman et al. |
| 7,193,562 | B2 * | 3/2007 | Shtrom et al. ..... 343/700 MS |
| 7,277,063 | B2 | 10/2007 | Shirosaka et al. |
| 7,295,825 | B2 * | 11/2007 | Raddant ..... 455/277.1 |
| 7,298,228 | B2 | 11/2007 | Sievenpiper |
| 7,312,762 | B2 | 12/2007 | Puente Ballarda |
| 7,319,432 | B2 | 1/2008 | Andersson |
| 7,362,280 | B2 * | 4/2008 | Shtrom et al. ..... 343/795 |
| 7,385,563 | B2 | 6/2008 | Bishop |
| 7,522,569 | B2 | 4/2009 | Rada |
| 7,697,550 | B2 | 4/2010 | Rada |
| 2001/0046848 | A1 | 11/2001 | Kenkel |
| 2002/0031130 | A1 | 3/2002 | Tsuchiya et al. |
| 2002/0047800 | A1 | 4/2002 | Proctor, Jr. et al. |
| 2002/0080767 | A1 | 6/2002 | Lee |
| 2002/0084942 | A1 | 7/2002 | Tsai |
| 2002/0101377 | A1 | 8/2002 | Crawford |
| 2002/0105471 | A1 | 8/2002 | Kojima et al. |
| 2002/0112058 | A1 | 8/2002 | Weisman et al. |
| 2002/0158798 | A1 | 10/2002 | Chiang et al. |
| 2002/0170064 | A1 | 11/2002 | Monroe et al. |
| 2003/0026240 | A1 | 2/2003 | Eyuboglu et al. |
| 2003/0030588 | A1 | 2/2003 | Kalis et al. |
| 2003/0063591 | A1 | 4/2003 | Leung et al. |
| 2003/0122714 | A1 | 7/2003 | Wannagot et al. |
| 2003/0169330 | A1 | 9/2003 | Ben-Shachar et al. |
| 2003/0184490 | A1 | 10/2003 | Raiman et al. |
| 2003/0189514 | A1 | 10/2003 | Miyano et al. |

| | | | |
|---|---|---|---|
| 2003/0189521 | A1 | 10/2003 | Yamamoto et al. |
| 2003/0189523 | A1 | 10/2003 | Ojantakanen et al. |
| 2003/0210207 | A1 | 11/2003 | Suh et al. |
| 2003/0227414 | A1 | 12/2003 | Saliga et al. |
| 2004/0014432 | A1 | 1/2004 | Boyle |
| 2004/0017310 | A1 | 1/2004 | Runkle et al. |
| 2004/0017860 | A1 | 1/2004 | Liu |
| 2004/0027291 | A1 | 2/2004 | Zhang et al. |
| 2004/0027304 | A1 | 2/2004 | Chiang et al. |
| 2004/0032378 | A1 | 2/2004 | Volman et al. |
| 2004/0036651 | A1 | 2/2004 | Toda |
| 2004/0036654 | A1 | 2/2004 | Hsieh |
| 2004/0041732 | A1 | 3/2004 | Aikawa et al. |
| 2004/0048593 | A1 | 3/2004 | Sano |
| 2004/0058690 | A1 | 3/2004 | Ratzel et al. |
| 2004/0061653 | A1 | 4/2004 | Webb et al. |
| 2004/0070543 | A1 | 4/2004 | Masaki |
| 2004/0080455 | A1 | 4/2004 | Lee |
| 2004/0095278 | A1 | 5/2004 | Kanemoto et al. |
| 2004/0114535 | A1 | 6/2004 | Hoffmann et al. |
| 2004/0125777 | A1 | 7/2004 | Doyle et al. |
| 2004/0145528 | A1 | 7/2004 | Mukai |
| 2004/0160376 | A1 | 8/2004 | Hornsby |
| 2004/0190477 | A1 | 9/2004 | Olson et al. |
| 2004/0203347 | A1 | 10/2004 | Nguyen |
| 2004/0227669 | A1 | 11/2004 | Okado |
| 2004/0260800 | A1 | 12/2004 | Gu et al. |
| 2005/0022210 | A1 | 1/2005 | Zintel et al. |
| 2005/0041739 | A1 | 2/2005 | Li et al. |
| 2005/0042988 | A1 | 2/2005 | Hoek et al. |
| 2005/0048934 | A1 | 3/2005 | Rawnick |
| 2005/0074018 | A1 | 4/2005 | Zintel et al. |
| 2005/0097503 | A1 | 5/2005 | Zintel et al. |
| 2005/0128983 | A1 | 6/2005 | Kim |
| 2005/0135480 | A1 | 6/2005 | Li et al. |
| 2005/0138137 | A1 | 6/2005 | Encarnacion et al. |
| 2005/0138193 | A1 | 6/2005 | Encarnacion et al. |
| 2005/0146475 | A1 | 7/2005 | Bettner |
| 2005/0180381 | A1 | 8/2005 | Retzer et al. |
| 2005/0188193 | A1 | 8/2005 | Kuehnel et al. |
| 2005/0240665 | A1 | 10/2005 | Gu et al. |
| 2005/0267935 | A1 | 12/2005 | Gandhi et al. |
| 2006/0094371 | A1 | 5/2006 | Nguyen |
| 2006/0098607 | A1 | 5/2006 | Zeng et al. |
| 2006/0123124 | A1 | 6/2006 | Weisman et al. |
| 2006/0123125 | A1 | 6/2006 | Weisman et al. |
| 2006/0123455 | A1 | 6/2006 | Pai et al. |
| 2006/0168159 | A1 | 7/2006 | Weisman et al. |
| 2006/0184660 | A1 | 8/2006 | Rao et al. |
| 2006/0184661 | A1 | 8/2006 | Weisman et al. |
| 2006/0184693 | A1 | 8/2006 | Rao et al. |
| 2006/0224690 | A1 | 10/2006 | Falkenburg et al. |
| 2006/0225107 | A1 | 10/2006 | Seetharaman et al. |
| 2006/0227761 | A1 | 10/2006 | Scott, II et al. |
| 2006/0239369 | A1 | 10/2006 | Lee |
| 2006/0262015 | A1 | 11/2006 | Thornell-Pers |
| 2006/0291434 | A1 | 12/2006 | Gu et al. |
| 2007/0027622 | A1 | 2/2007 | Cleron et al. |
| 2007/0135167 | A1 | 6/2007 | Liu |
| 2008/0062058 | A1 | 3/2008 | Bishop |
| 2009/0315794 | A1 | 12/2009 | Alamouti et al. |

FOREIGN PATENT DOCUMENTS

| | | | |
|---|---|---|---|
| EP | 352787 | A2 | 1/1990 |
| EP | 0 534 612 | | 3/1993 |
| EP | 0756381 | A2 | 1/1997 |
| EP | 0883206 | A2 | 5/1998 |
| EP | 1152542 | A1 | 11/2001 |
| EP | 1 376 920 | | 6/2002 |
| EP | 1 315 311 | | 5/2003 |
| EP | 1 450 521 | | 8/2004 |
| EP | 1 608 108 | | 12/2005 |
| GB | 2426870 | A | 6/2006 |
| GB | 2423191 | A | 8/2006 |
| JP | 03038933 | | 2/1991 |
| JP | 2008/088633 | | 2/1996 |
| JP | 2001/057560 | | 2/2002 |
| JP | 2005/354249 | | 12/2005 |
| JP | 2006/060408 | | 3/2006 |
| WO | WO 90/04893 | | 5/1990 |
| WO | 9955012 | A2 | 10/1999 |
| WO | WO 0113461 | A1 | 2/2001 |
| WO | WO 02/25967 | | 3/2002 |
| WO | WO 03/079484 | | 9/2003 |
| WO | W02004051798 | | 6/2004 |

OTHER PUBLICATIONS

Ando et al., "Study of Dual-Polarized Omni-Directional Antennas for 5.2 GHz-Band 2×2 MIMO-OFDM Systems," Antennas and Propogation Society International Symposium, 2004, IEEE, pp. 1740-1743 vol. 2.

Bedell, Paul, "Wireless Crash Course," 2005, p. 84, The McGraw-Hill Companies, Inc., USA.

Petition Decision Denying Request to Order Additional Claims for U.S. Patent No. 7,193,562 (Control No. 95/001078) mailed on Jul. 10, 2009.

Right of Appeal Notice for U.S. Patent No. 7,193,562 (Control No. 95/001078) mailed on Jul. 10, 2009.

Third Party Comments after Patent Owner's Response in Accordance with 37 CFR 1.947 for U.S. Patent No. 7,358,912 (Control No. 95/001079) filed on Jun. 17, 2009.

Supplementary European Search Report for foreign application No. EP07755519 dated Mar. 11, 2009.

Chuang et al., "A 2.4 GHz Polarization-diversity Planar Printed Dipole Antenna for WLAN and Wireless Communication Applications," Microwave Journal, 2002, vol. 45, No. 6, pp. 50-62.

Frederick et al., "Smart Antennas Based on Spatial Multiplexing of Local Elements (SMILE) for Mutual Coupling Reduction," IEEE Transactions of Antennas and Propogation, 2004, vol. 52, No. 1, pp. 106-114.

Doherty Jr. et al., The Pin Diode Circuit Designer's Handbook, 1998.

Varnes et al., "A Switched Radial Divider for an L-Band Mobile Satellite Antenna," European Microwave Conference, 1995, pp. 1037-1041.

English translation of PCT Pub. No. WO2004/051498 (as filed U.S. Appl. No. 10/536,547.).

Behdad et al., "Slot Antenna Miniaturization Using Distributed Inductive Loading," Antennas and Propogation Society International Symposium, 2003, IEEE, pp. 308-311, vol. 1.

Press Release, "NETGEAR RangeMax(TM) Wireless Networking Solutions Incorporate Smart MIMO Technology to Eliminate Wireless Dead Spots and Take Consumers Farther," Ruckus Wireless, Inc., Mar. 7, 2005, available at http://ruckuswireless.com/press/releases/20050307.php.

Request for Inter Partes Rexamination for U.S. Patent No. 7,358,912, filed by Rayspan Corporation and Netgear, Inc. on Sep. 4, 2008.

Office Action issued in Reexamination for U.S. Patent No. 7,358,912 (No. 95/001079), mailed Mar. 19, 2009.

Response to Mar. 19, 2009 Office Action issued in Reexamination for U.S. Patent No. 7,358,912 (No. 95/001079), filed May 19, 2009.

Supplementary European Search Report mailed Jul. 21, 2009 in European patent application No. 05 776697.4-1248.

ORINOCO AP-2000 5GHz Kit, "Access Point Family," Proxim Wireless Corporation.

Ken Tang, et al., "MAC Layer Broadcast Support in 802.11 Wireless Networks," Computer Science Department, University of California, Los Angeles, 2000 IEEE, pp. 544-548.

Ken Tang, et al., "MAC Reliable Broadcast in Ad Hoc Networks," Computer Science Department, University of California, Los Angeles, 2001 IEEE, pp. 1008-1013.

Vincent D. Park, et al., "A Performance Comparison of the Temporally-Ordered Routing Algorithm and Ideal Link-State Routing," IEEE, Jul. 1998, pp. 592-598.

Ian F. Akyildiz, et al., "A Virtual Topology Based Routing Protocol for Multihop Dynamic Wireless Networks," Broadband and Wireless Networking Lab, School of Electrical and Computer Engineering, Georgia Institute of Technology.

Dell Inc., "How Much Broadcast and Multicast Traffic Should I Allow in My Network," PowerConnect Application Note #5, Nov. 2003.

Toskala, Antti, "Enhancement of Broadcast and Introduction of Multicast Capabilities in RAN," Nokia Networks, Palm Springs, California, Mar. 13-16, 2001.
Microsoft Corporation, "IEEE 802.11 Networks and Windows XP," Windows Hardware Developer Central, Dec. 4, 2001.
Festag, Andreas, "What is MOMBASA?" Telecommunication Networks Group (TKN), Technical University of Berlin, Mar. 7, 2002.
Hewlett Packard, "HP ProCurve Networking: Enterprise Wireless LAN Networking and Mobility Solutions," 2003.
Dutta, Ashutosh et al., "MarconiNet Supporting Streaming Media Over Localized Wireless Multicast," Proc. of the 2d Int'l Workshop on Mobile Commerce, 2002.
Dunkels, Adam et al., "Making TCP/IP Viable for Wireless Sensor Networks," Proc. of the 1st Euro. Workshop on Wireless Sensor Networks, Berlin, Jan. 2004.
Dunkels, Adam et al., "Connecting Wireless Sensornets with TCP/IP Networks," Proc. of the 2d Int'l Conf. on Wired Networks, Frankfurt, Feb. 2004.
Cisco Systems, "Cisco Aironet Access Point Software Configuration Guide: Configuring Filters and Quality of Service," Aug. 2003.
Hirayama, Koji et al., "Next-Generation Mobile-Access IP Network," Hitachi Review vol. 49, No. 4, 2000.
Pat Calhoun et al., "802.11r strengthens wireless voice," Technology Update, Network World, Aug. 22, 2005, http://www.networkworld.com/news/tech/2005/082208techupdate.html.
Areg Alimian et al., "Analysis of Roaming Techniques," doc.:IEEE 802.11-04/0377r1, Submission, Mar. 2004.
Information Society Technologies Ultrawaves, "System Concept / Architecture Design and Communication Stack Requirement Document," Feb. 23, 2004.
Golmie, Nada, "Coexistence in Wireless Networks: Challenges and System-Level Solutions in the Unlicensed Bands," Cambridge University Press, 2006.
Mawa, Rakesh, "Power Control in 3G Systems," Hughes Systique Corporation, Jun. 28, 2006.
Wennstrom, Mattias et al., "Transmit Antenna Diversity in Ricean Fading MIMO Channels with Co-Channel Interference," 2001.
"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.
"Authorization of spread spectrum and other wideband emissions not presently provided for in the FCC Rules and Regulations," Before the Federal Communications Commission, FCC 81-289, 87 F.C.C.2d 876, Jun. 30, 1981.
RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.
Chang, Robert W., "Synthesis of Band-Limited Orthogonal Signals for Multichannel Data Transmission," The Bell System Technical Journal, Dec. 1966, pp. 1775-1796.
Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.
Saltzberg, Burton R., "Performance of an Efficient Parallel Data Transmission System," IEEE Transactions on Communication Technology, vol. Com-15, No. 6, Dec. 1967, pp. 805-811.
Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.
Moose, Paul H., "Differential Modulation and Demodulation of Multi-Frequency Digital Communications Signals," 1990 IEEE,CH2831-6/90/0000-0273.
Casas, Eduardo F., et al., "OFDM for Data Communication Over Mobile Radio FM Channels-Part I: Analysis and Experimental Results," IEEE Transactions on Communications, vol. 39, No. 5, May 1991, pp. 783-793.
Casas, Eduardo F., et al., "OFDM for Data Communication over Mobile Radio FM Channels; Part II: Performance Improvement," Department of Electrical Engineering, University of British Columbia.
Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.
Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Alard, M., et al., "Principles of Modulation and Channel Coding for Digital Broadcasting for Mobile Receivers," 8301 EBU Review Technical, Aug. 1987, No. 224, Brussels, Belgium.
Berenguer, Inaki, et al., "Adaptive MIMO Antenna Selection," Nov. 2003.
Gaur, Sudhanshu, et al., "Transmit/Receive Antenna Selection for MIMO Systems to Improve Error Performance of Linear Receivers," School of ECE, Georgia Institute of Technology, Apr. 4, 2005.
Sadek, Mirette, et al., "Active Antenna Selection in Multiuser MIMO Communications," IEEE Transactions on Signal Processing, vol. 55, No. 4, Apr. 2007, pp. 1498-1510.
Molisch, Andreas F., et al., "MIMO Systems with Antenna Selection-an Overview," Draft, Dec. 31, 2003.
Steger, Christopher et al., "Performance of IEEE 802.11b Wireless LAN in an Emulated Mobile Channel," 2003.
Chang, Nicholas B. et al., "Optimal Channel Probing and Transmission Scheduling for Opportunistics Spectrum Access," Sep. 2007.
Examination Report mailed on Jan. 21, 2011 and received in European patent application No. 05 776 697.4.

* cited by examiner

COVERAGE ANTENNA APPARATUS WITH SELECTABLE HORIZONTAL AND VERTICAL POLARIZATION ELEMENTS

CROSS-REFERENCE TO RELATED APPLICATIONS

This application is a continuation and claims the priority benefit of U.S. patent application Ser. No. 11/413,461 filed Apr. 28, 2006 now U.S. Pat. No. 7,358,912 and titled "Coverage Antenna Apparatus with Selectable Horizontal and Vertical Polarization Elements," which claims the priority benefit of U.S. provisional patent application No. 60/694,101 filed Jun. 24, 2005, the disclosures of which are incorporated herein by reference.

This application is related to and incorporates by reference co-pending U.S. patent application Ser. No. 11/041,145 filed Jan. 21, 2005 and titled "System and Method for a Minimized Antenna Apparatus with Selectable Elements"; U.S. patent application Ser. No. 11/022,080 filed Dec. 23, 2004 and titled "Circuit Board having a Peripheral Antenna Apparatus with Selectable Antenna Elements"; U.S. patent application Ser. No. 11/010,076 filed Dec. 9, 2004 and titled "System and Method for an Omnidirectional Planar Antenna Apparatus with Selectable Elements"; U.S. patent application Ser. No. 11/180,329 filed Jul. 12, 2005 and titled "System and Method for Transmission Parameter Control for an Antenna Apparatus with Selectable Elements"; and U.S. patent application Ser. No. 11/190,288 filed Jul. 26, 2005 and titled "Wireless System Having Multiple Antennas and Multiple Radios".

BACKGROUND OF INVENTION

1. Field of the Invention

The present invention relates generally to wireless communications, and more particularly to an antenna apparatus with selectable horizontal and vertical polarization elements.

2. Description of the Prior Art

In communications systems, there is an ever-increasing demand for higher data throughput and a corresponding drive to reduce interference that can disrupt data communications. For example, in an IEEE 802.11 network, an access point (i.e., base station) communicates data with one or more remote receiving nodes or stations, e.g., a network interface card of a laptop computer, over a wireless link. The wireless link may be susceptible to interference from other access points and stations, other radio transmitting devices, changes or disturbances in the wireless link environment between the access point and the remote receiving node, and so on. The interference may be such to degrade the wireless link, for example by forcing communication at a lower data rate, or may be sufficiently strong to completely disrupt the wireless link.

One method for reducing interference in the wireless link between the access point and the remote receiving node is to provide several omnidirectional antennas, in a "diversity" scheme. For example, a common configuration for the access point comprises a data source coupled via a switching network to two or more physically separated omnidirectional antennas. The access point may select one of the omnidirectional antennas by which to maintain the wireless link. Because of the separation between the omnidirectional antennas, each antenna experiences a different signal environment, and each antenna contributes a different interference level to the wireless link. The switching network couples the data source to whichever of the omnidirectional antennas experiences the least interference in the wireless link. However, one problem with using two or more omnidirectional antennas for the access point is that typical omnidirectional antennas are vertically polarized. Vertically polarized radio frequency (RF) energy does not travel as efficiently as horizontally polarized RF energy inside a typical office or dwelling space. Typical horizontally polarized RF antennas to date have been expensive to manufacture, or do not provide adequate RF performance to be commercially successful.

A further problem is that the omnidirectional antenna typically comprises an upright wand attached to a housing of the access point. The wand typically comprises a hollow metallic rod exposed outside of the housing, and may be subject to breakage or damage. Another problem is that each omnidirectional antenna comprises a separate unit of manufacture with respect to the access point, thus requiring extra manufacturing steps to include the omnidirectional antennas in the access point. Yet another problem is that the access point with the typical omnidirectional antennas is a relatively large physically, because the omnidirectional antennas extend from the housing.

A still further problem with the two or more omnidirectional antennas is that because the physically separated antennas may still be relatively close to each other, each of the several antennas may experience similar levels of interference and only a relatively small reduction in interference may be gained by switching from one omnidirectional antenna to another omnidirectional antenna.

Another method to reduce interference involves beam steering with an electronically controlled phased array antenna. However, the phased array antenna can be extremely expensive to manufacture. Further, the phased array antenna can require many phase tuning elements that may drift or otherwise become maladjusted.

SUMMARY OF THE INVENTION

In one aspect, a system comprises a communication device configured to generate or receive a radio frequency (RF) signal, an antenna apparatus configured to radiate or receive the RF signal, and an antenna element selector. The antenna apparatus includes a first planar element configured to radiate or receive the RF signal in a horizontal polarization and a second planar element configured to radiate or receive the RF signal in a vertical polarization. The antenna element selector is configured to couple the RF signal to the first planar element or the second planar element.

In some embodiments, the antenna apparatus is configured to radiate or receive the RF signal in a diagonal polarization if the first planar element and the second planar element are coupled to the RF signal. The antenna apparatus may be configured to radiate or receive the RF signal in a substantially omnidirectional radiation pattern. The first planar element may comprise a slot antenna and the second planar element may comprise a dipole. The antenna element selector may comprise a PIN diode network configured to couple the RF signal to the first planar element or the second planar element.

In one aspect, an antenna apparatus comprises a first substrate including a first planar element and a second planar element. The first planar element is configured to radiate or receive a radio frequency (RF) signal in a horizontal polarization. The second planar element is configured to radiate or receive the RF signal in a vertical polarization.

In some embodiments, the first planar element and the second planar element comprise a circuit board. The antenna apparatus may comprise a second substrate including a third planar element coupled substantially perpendicularly to the circuit board. The second substrate may be coupled to the circuit board by solder.

In one aspect, a method of manufacturing an antenna apparatus comprises forming a first antenna element and a second antenna element from a printed circuit board substrate, partitioning the printed circuit board substrate into a first portion including the first antenna element and a second portion including the second antenna element and coupling the first portion to the second portion to form a non-planar antenna apparatus. Coupling the first portion to the second portion may comprise soldering the first portion to the second portion.

In one aspect, a system comprises a housing, a communication device, and an antenna apparatus including one or more slot antennas integral with the housing. One or more of the slot antennas may comprise loading elements configured to decrease a footprint of the slot antenna. One or more of the slot antennas may comprise an aperture formed in the housing.

BRIEF DESCRIPTION OF DRAWINGS

The present invention will now be described with reference to drawings that represent a preferred embodiment of the invention. In the drawings, like components have the same reference numerals. The illustrated embodiment is intended to illustrate, but not to limit the invention. The drawings include the following figures.

DETAILED DESCRIPTION

Figure 1:
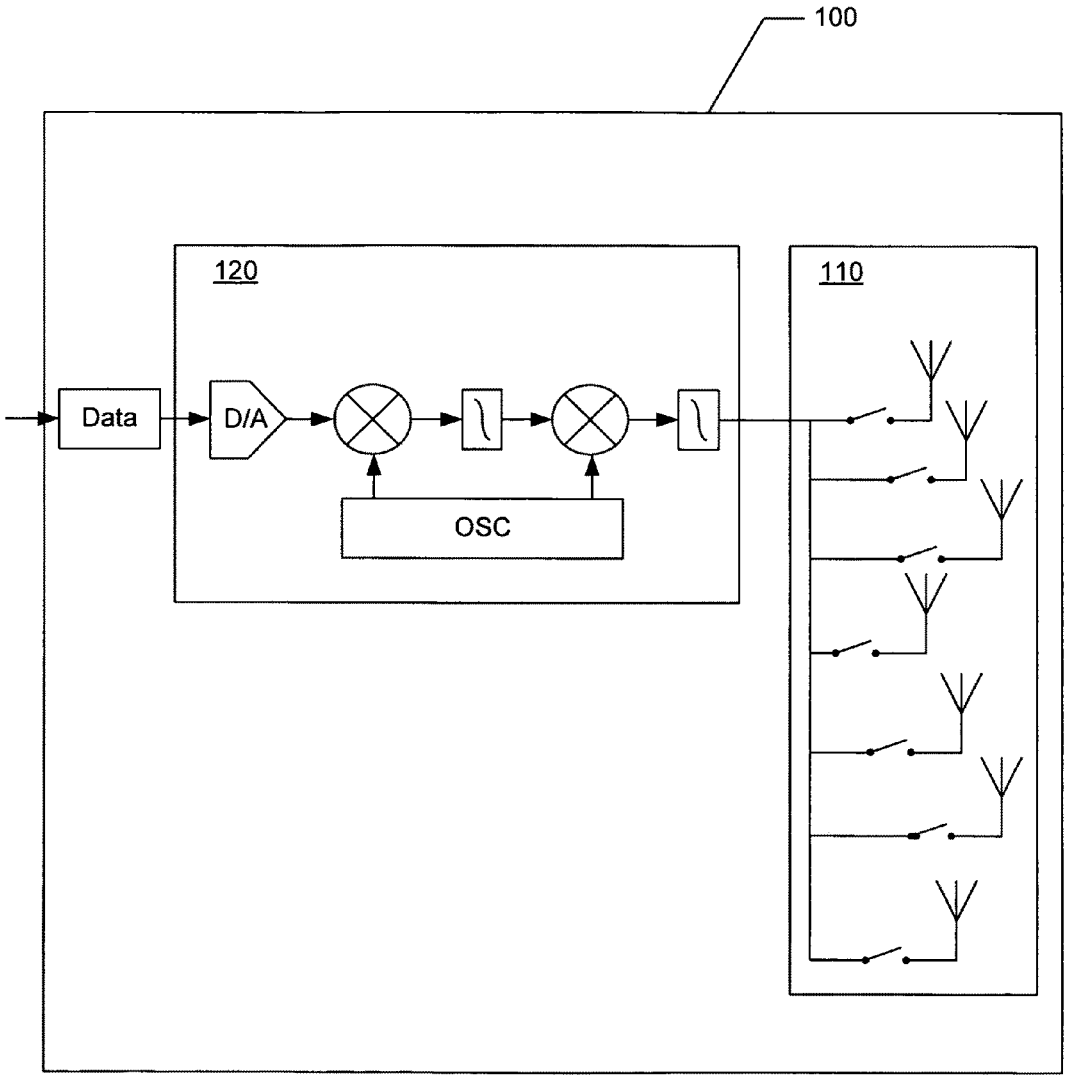
FIG. 1 illustrates a system comprising an antenna apparatus with selectable horizontal and vertical polarization elements, in one embodiment in accordance with the present invention.

A system for a wireless (i.e., radio frequency or RF) link to a remote receiving node includes a communication device for generating an RF signal and an antenna apparatus for transmitting and/or receiving the RF signal. The antenna apparatus comprises a plurality of modified dipoles (also referred to herein as simply "dipoles") and/or a plurality of modified slot antennas (also referred to herein as simply "slots"). In a preferred embodiment, the antenna apparatus includes a number of slots configured to transmit and/or receive horizontal polarization, and a number of dipoles to provide vertical polarization. Each dipole and each slot provides gain (with respect to isotropic) and a polarized directional radiation pattern. The slots and the dipoles may be arranged with respect to each other to provide offset radiation patterns.

In some embodiments, the dipoles and the slots comprise individually selectable antenna elements and each antenna element may be electrically selected (e.g., switched on or off) so that the antenna apparatus may form a configurable radiation pattern. An antenna element selector is included with or coupled to the antenna apparatus so that one or more of the individual antenna elements may be selected or active. If certain or all elements are switched on, the antenna apparatus forms an omnidirectional radiation pattern, with both vertically polarized and horizontally polarized (also referred to herein as diagonally polarized) radiation. For example, if two or more of the dipoles are switched on, the antenna apparatus may form a substantially omnidirectional radiation pattern with vertical polarization. Similarly, if two or more of the slots are switched on, the antenna apparatus may form a substantially omnidirectional radiation pattern with horizontal polarization.

The antenna apparatus is easily manufactured from common planar substrates such as an FR4 printed circuit board (PCB). The PCB may be partitioned into portions including one or more elements of the antenna apparatus, which portions may then be arranged and coupled (e.g., by soldering) to form a non-planar antenna apparatus having a number of antenna elements.

In some embodiments, the slots may be integrated into or conformally mounted to a housing of the system, to minimize cost and size of the system, and to provide support for the antenna apparatus.

Advantageously, a controller of the system may select a particular configuration of antenna elements and a corresponding configurable radiation pattern that minimizes interference over the wireless link to the remote receiving node. If the wireless link experiences interference, for example due to other radio transmitting devices, or changes or disturbances in the wireless link between the system and the remote receiving node, the system may select a different combination of selected antenna elements to change the corresponding radiation pattern and minimize the interference. The system may select a configuration of selected antenna elements corresponding to a maximum gain between the system and the remote receiving node. Alternatively, the system may select a configuration of selected antenna elements corresponding to less than maximal gain, but corresponding to reduced interference in the wireless link.

FIG. 1 illustrates a system 100 comprising an antenna apparatus 110 with selectable horizontal and vertical polarization elements, in one embodiment in accordance with the present invention. The system 100 may comprise, for example without limitation, a transmitter and/or a receiver, such as an 802.11 access point, an 802.11 receiver, a set-top box, a laptop computer, a television, a PCMCIA card, a remote control, a Voice Over Internet telephone, and a remote terminal such as a handheld gaming device.

In some exemplary embodiments, the system 100 comprises an access point for communicating to one or more remote receiving nodes (not shown) over a wireless link, for example in an 802.11 wireless network. Typically, the system 100 may receive data from a router connected to the Internet (not shown), and the system 100 may transmit the data to one or more of the remote receiving nodes. The system 100 may also form a part of a wireless local area network by enabling communications among several remote receiving nodes. Although the disclosure will focus on a specific embodiment for the system 100, aspects of the invention are applicable to a wide variety of appliances, and are not intended to be limited to the disclosed embodiment. For example, although the system 100 may be described as transmitting to the remote receiving node via the antenna apparatus, the system 100 may also receive data from the remote receiving node via the antenna apparatus.

The system 100 includes a communication device 120 (e.g., a transceiver) and an antenna apparatus 110. The communication device 120 comprises virtually any device for generating and/or receiving an RF signal. The communication device 120 may include, for example, a radio modulator/demodulator for converting data received into the system 100 (e.g., from the router) into the RF signal for transmission to one or more of the remote receiving nodes. In some embodiments, the communication device 120 comprises well-known circuitry for receiving data packets of video from the router and circuitry for converting the data packets into 802.11 compliant RF signals.

As described further herein, the antenna apparatus 110 comprises a plurality of antenna elements including a plurality of dipoles and/or a plurality of slots. The dipoles are configured to generate vertical polarization, and the slots are configured to generate horizontal polarization. Each of the antenna elements provides gain (with respect to isotropic).

In embodiments with individually selectable antenna elements, each antenna element may be electrically selected (e.g., switched on or off) so that the antenna apparatus 110 may form a configurable radiation pattern. The antenna apparatus 110 may include an antenna element selecting device configured to selectively couple one or more of the antenna elements to the communication device 120. By selectively coupling one or more of the antenna elements to the communication device 120, the system 100 may transmit/receive with horizontal polarization, vertical polarization, or diagonal polarization. Further, the system 100 may also transmit/receive with configurable radiation patterns ranging from highly directional to substantially omnidirectional, depending upon which of the antenna elements are coupled to the communication device 120.

Mechanisms for selecting one or more of the antenna elements are described further in particular in co-pending U.S. application Ser. No. 11/180,329 titled "System and Method for Transmission Parameter Control for an Antenna Apparatus with Selectable Elements" filed Jul. 12, 2005, and other applications listed herein and incorporated by reference.

Figure 2:
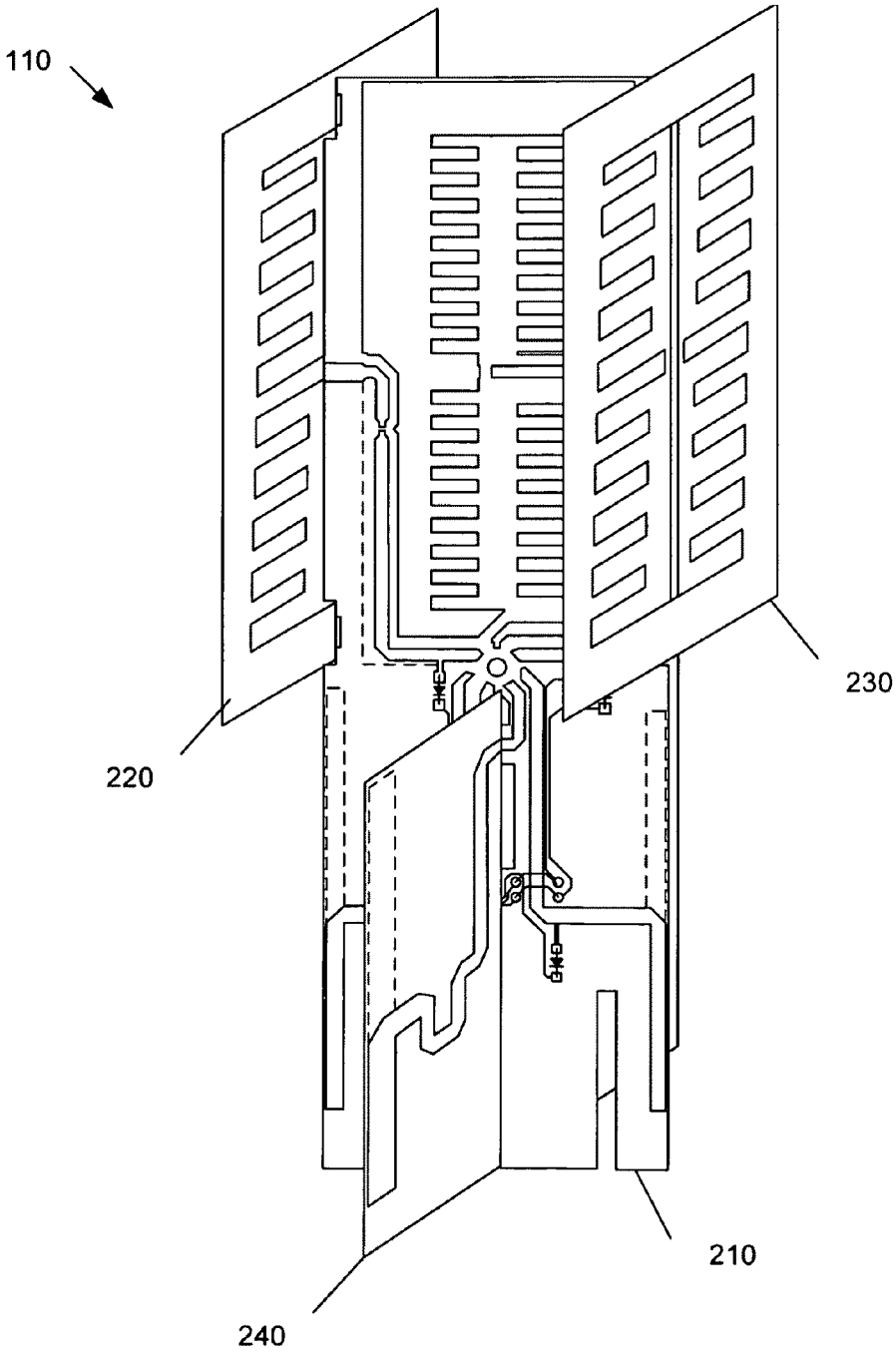
FIG. 2 illustrates the antenna apparatus of FIG. 1, in one embodiment in accordance with the present invention.

FIG. 2 illustrates the antenna apparatus 110 of FIG. 1, in one embodiment in accordance with the present invention. The antenna apparatus 110 of this embodiment includes a first substrate 210 (parallel to the plane of FIG. 2), a second substrate 220 (perpendicular to the plane of FIG. 2), a third substrate 230 (perpendicular to the plane of FIG. 2), and a fourth substrate 240 (perpendicular to the plane of FIG. 2).

As described further with respect to FIG. 3, the first substrate 210 includes a slot, two dipoles, and an antenna element selector (not labeled, for clarity). The second substrate 220 includes a slot antenna perpendicular to and coupled to a first edge of the first substrate 210. The third substrate 230 includes a slot perpendicular to and opposite from the second substrate 220 on the first substrate 210. The fourth substrate 240 includes two dipoles (one of the dipoles is obscured in FIG. 2 by the first substrate 210) and is perpendicular to and coupled to the first substrate 210.

As described further herein, the substrates 210-240 may be partitioned or sectioned from a single PCB. The substrates 210-240 have a first side (depicted as solid lines) and a second side (depicted as dashed lines) substantially parallel to the first side. The substrates 210-240 comprise a PCB such as FR4, Rogers 4003, or other dielectric material.

Figure 3A:
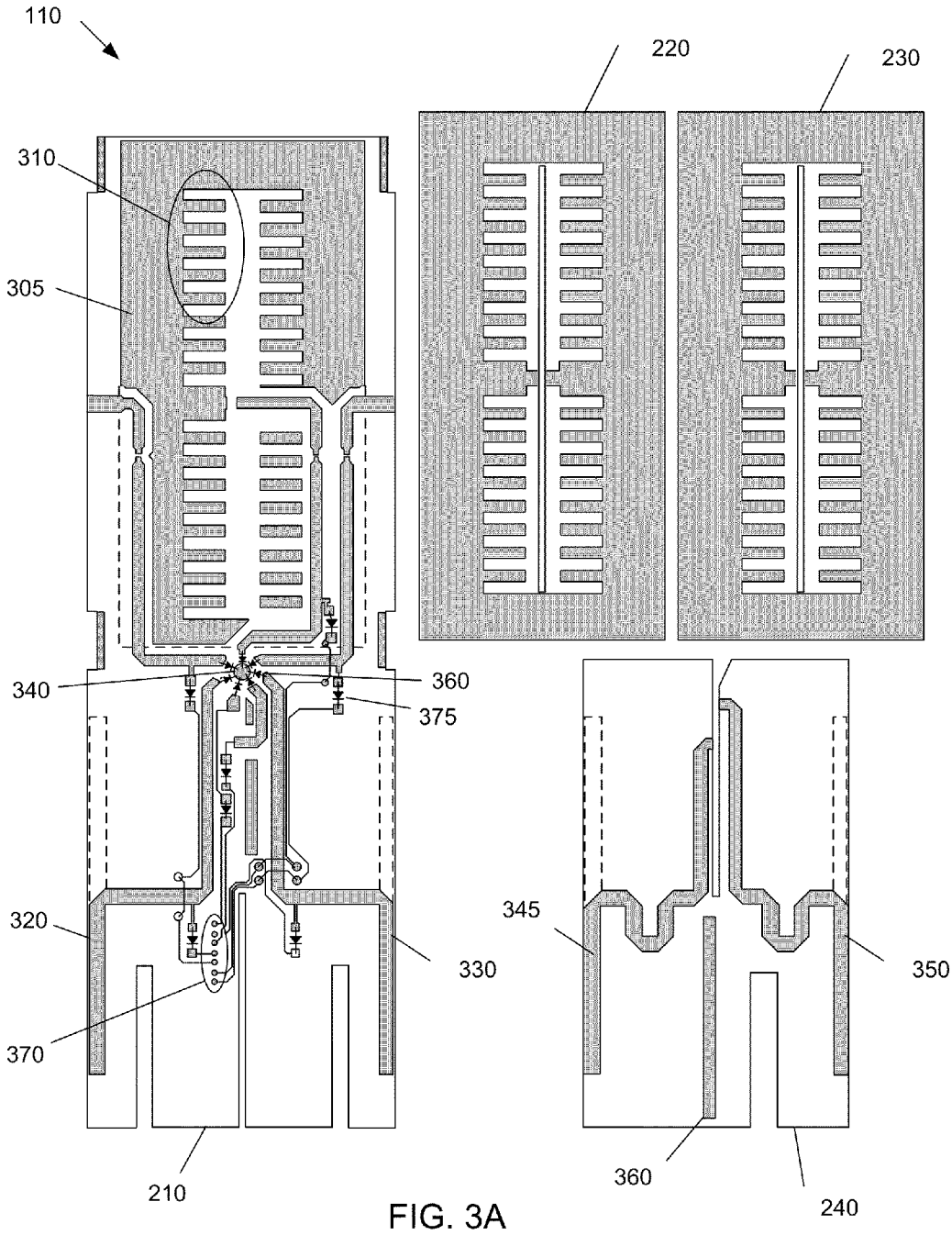
FIG. 3A illustrates PCB components (in solid lines and shading, not to scale) for forming the slots, dipoles, and antenna element selector on the first side of the substrates of FIG. 2, in one embodiment in accordance with the present invention.

FIG. 3A illustrates PCB components (in solid lines and shading, not to scale) for forming the slots, dipoles, and antenna element selector on the first side of the substrates 210-240 of FIG. 2, in one embodiment in accordance with the present invention. PCB components on the second side of the substrates 210-240 (described with respect to FIG. 3B) are shown as dashed lines. Dimensions in mils of the PCB components depicted in FIGS. 3A and 3B (collectively, FIG. 3) are depicted in FIG. 4.

The first side of the substrate 210 includes a portion 305 of a first slot antenna including "fingers" 310 (only a few of the fingers 310 are circled, for clarity), a portion 320 of a first dipole, a portion 330 of a second dipole, and the antenna element selector (not labeled for clarity). The antenna element selector includes a radio frequency feed port 340 for receiving and/or transmitting an RF signal to the communication device 110, and a coupling network (not labeled) for selecting one or more of the antenna elements.

The first side of the substrate 220 includes a portion of a second slot antenna including fingers. The first side of the substrate 230 also includes a portion of a third slot antenna including fingers.

As depicted, to minimize or reduce the size of the antenna apparatus 110, each of the slots includes fingers. The fingers are configured to slow down electrons, changing the resonance of each slot, thereby making each of the slots electrically shorter. At a given operating frequency, providing the fingers allows the overall dimension of the slot to be reduced, and reduces the overall size of the antenna apparatus 110.

The first side of the substrate 240 includes a portion 345 of a third dipole and portion 350 of a fourth dipole. One or more of the dipoles may optionally include passive elements, such as a director 360 (only one director shown for clarity). Directors comprise passive elements that constrain the directional radiation pattern of the modified dipoles, for example to increase the gain of the dipole. Directors are described in more detail in U.S. application Ser. No. 11/010,076 titled "System and Method for an Omnidirectional Planar Antenna Apparatus with Selectable Elements" filed Dec. 9, 2004 and other co-pending applications referenced herein and incorporated by reference.

The radio frequency feed port 340 and the coupling network of the antenna element selector are configured to selectively couple the communication device 110 of FIG. 1 to one or more of the antenna elements. It will be apparent to a person or ordinary skill that many configurations of the coupling network may be used to couple the radio frequency feed port 340 to one or more of the antenna elements.

In the embodiment of FIG. 3, the radio frequency feed port 340 is configured to receive an RF signal from and/or transmit an RF signal to the communication device 110, for example by an RF coaxial cable coupled to the radio frequency feed port 340. The coupling network is configured with DC blocking capacitors (not shown) and active RF switches 360 (shown schematically, not all RF switches labeled for clarity) to couple the radio frequency feed port 340 to one or more of the antenna elements.

The RF switches 360 are depicted as PIN diodes, but may comprise RF switches such as GaAs FETs or virtually any RF switching device. The PIN diodes comprise single-pole single-throw switches to switch each antenna element either on or off (i.e., couple or decouple each of the antenna elements to the radio frequency feed port 340). A series of control signals may be applied via a control bus 370 (circled in FIG. 3A) to bias each PIN diode. With the PIN diode forward biased and conducting a DC current, the PIN diode switch is on, and the corresponding antenna element is selected. With the diode reverse biased, the PIN diode switch is off.

In some embodiments, one or more light emitting diodes (LEDs) 375 (not all LED are labeled for clarity) are optionally included in the coupling network as a visual indicator of which of the antenna elements is on or off. A light emitting diode may be placed in circuit with the PIN diode so that the light emitting diode is lit when the corresponding antenna element is selected.

Figure 3B:
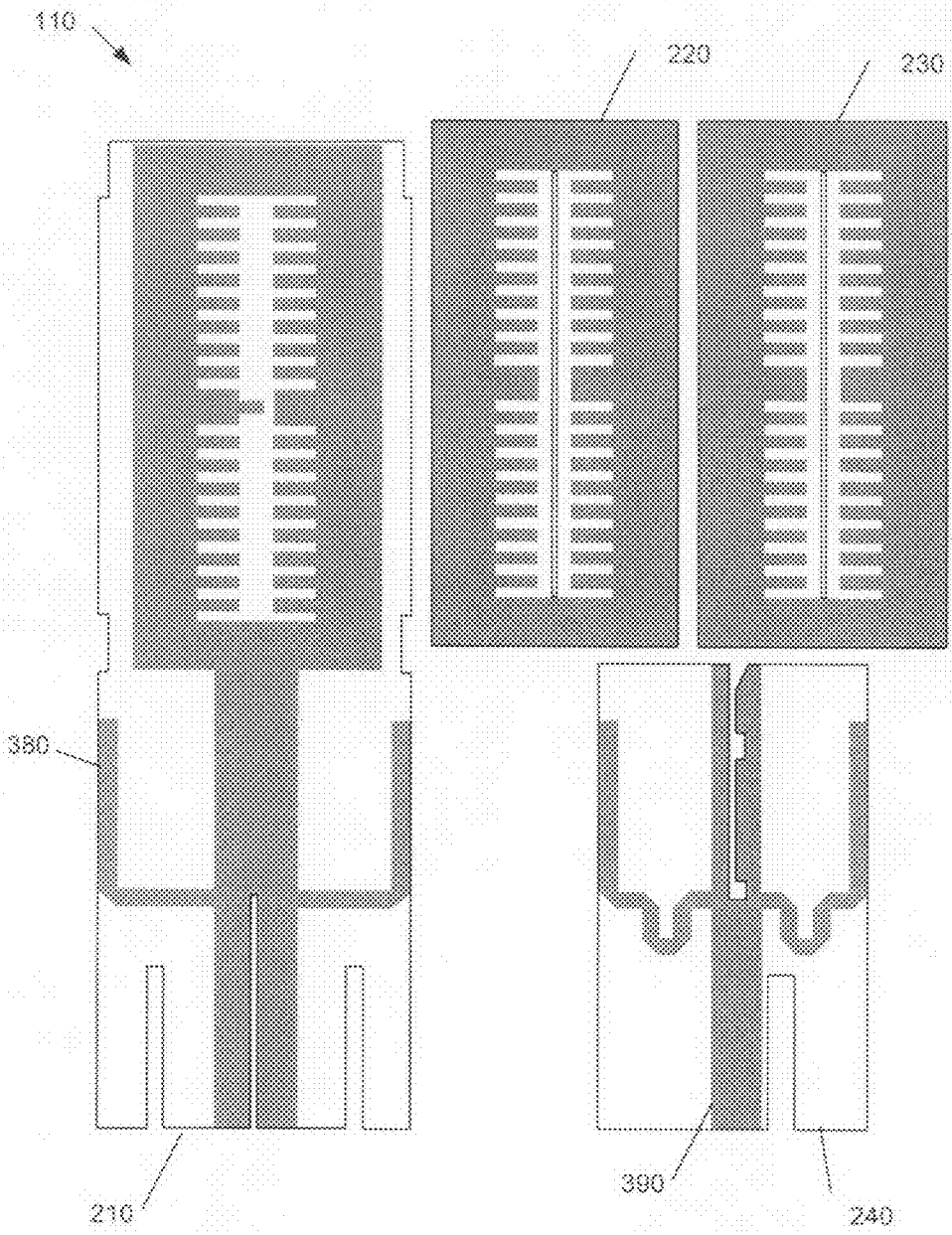
FIG. 3B illustrates PCB components (not to scale) for forming the slots, dipoles, and antenna element selector on the second side of the substrates of FIG. 2 for the antenna apparatus of FIG. 1, in one embodiment in accordance with the present invention.
Figure 4:
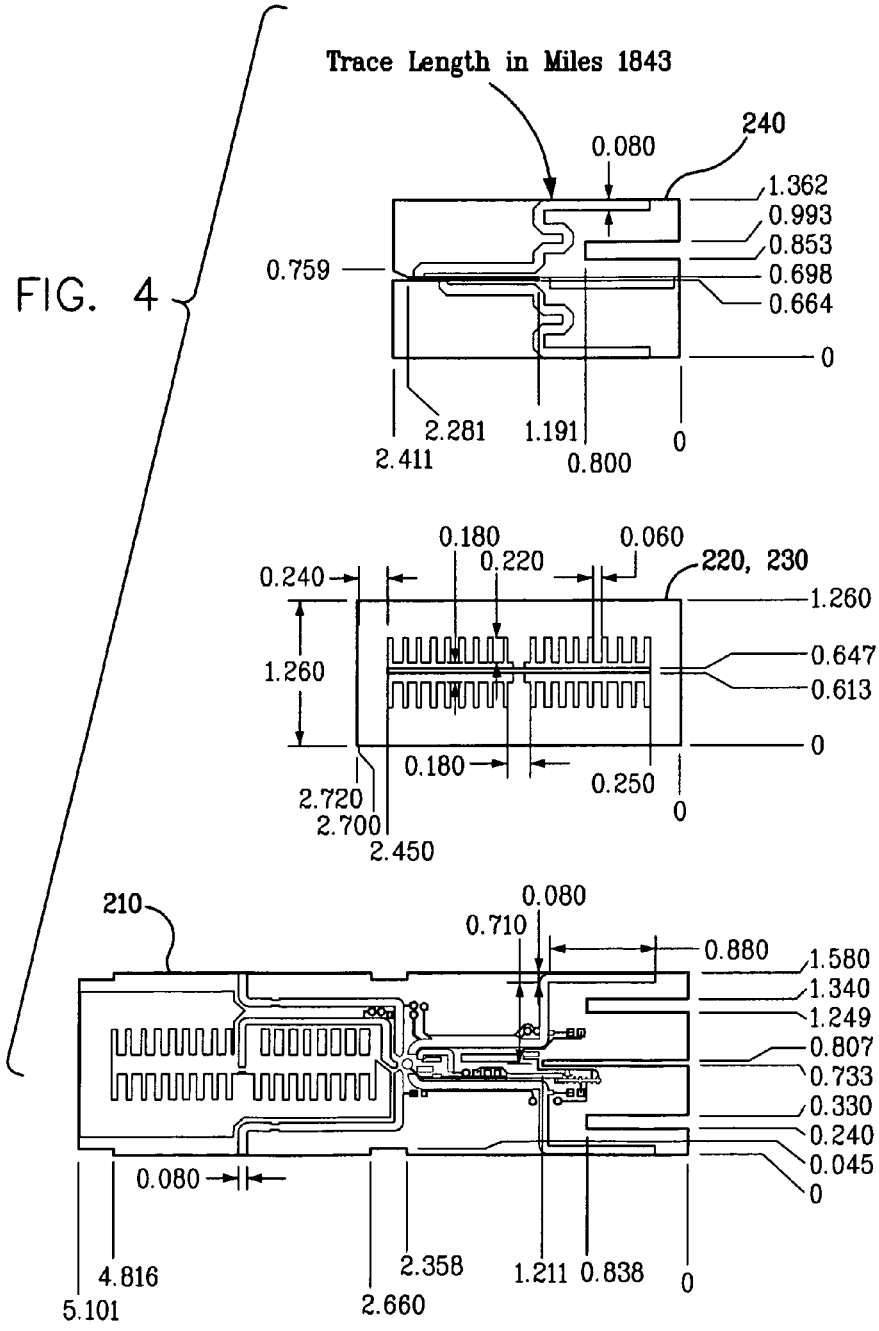
FIG. 4 illustrates various dimensions (in mils) for antenna elements of the antenna apparatus of FIG. 3, in one embodiment in accordance with the present invention.

FIG. 3B illustrates PCB components (not to scale) for forming the slots, dipoles, and antenna element selector on the second side of the substrates 210-240 of FIG. 2 for the antenna apparatus 110 of FIG. 1, in one embodiment in accordance with the present invention. PCB components on the first side of the substrates 210-240 (described with respect to FIG. 3A) are not shown for clarity.

On the second side of the substrates 210-240, the antenna apparatus 110 includes ground components configured to "complete" the dipoles and the slots on the first side of the substrates 210-240. For example, the portion of the dipole 320 on the first side of the substrate 210 (FIG. 3A) is completed by the portion 380 on the second side of the substrate 210 (FIG. 3B). The resultant dipole provides a vertically polarized directional radiation pattern substantially in the plane of the substrate 210.

Optionally, the second side of the substrates 210-240 may include passive elements for modifying the radiation pattern of the antenna elements. Such passive elements are described in detail in U.S. application Ser. No. 11/010,076 titled "System and Method for an Omnidirectional Planar Antenna Apparatus with Selectable Elements" filed Dec. 9, 2004 and other co-pending applications referenced herein and incorporated by reference. For example, the substrate 240 includes a reflector 390 as part of the ground component. The reflector 390 is configured to broaden the frequency response of the dipoles.

FIG. 4 illustrates various dimensions (in mils) for antenna elements of the antenna apparatus 110 of FIG. 3, in one embodiment in accordance with the present invention. It will be appreciated that the dimensions of individual components of the antenna apparatus 110 depend upon a desired operating frequency of the antenna apparatus 110. The dimensions of the individual components may be established by use of RF simulation software, such as IE3D from Zeland Software of Fremont, Calif. For example, the antenna apparatus 110 incorporating the components of dimension according to FIG. 4 is designed for operation near 2.4 GHz, based on a substrate PCB of FR4 material, but it will be appreciated by a person of ordinary skill that a different substrate having different dielectric properties, such as Rogers 4003, may require different dimensions than those shown in FIG. 4.

Figure 5:
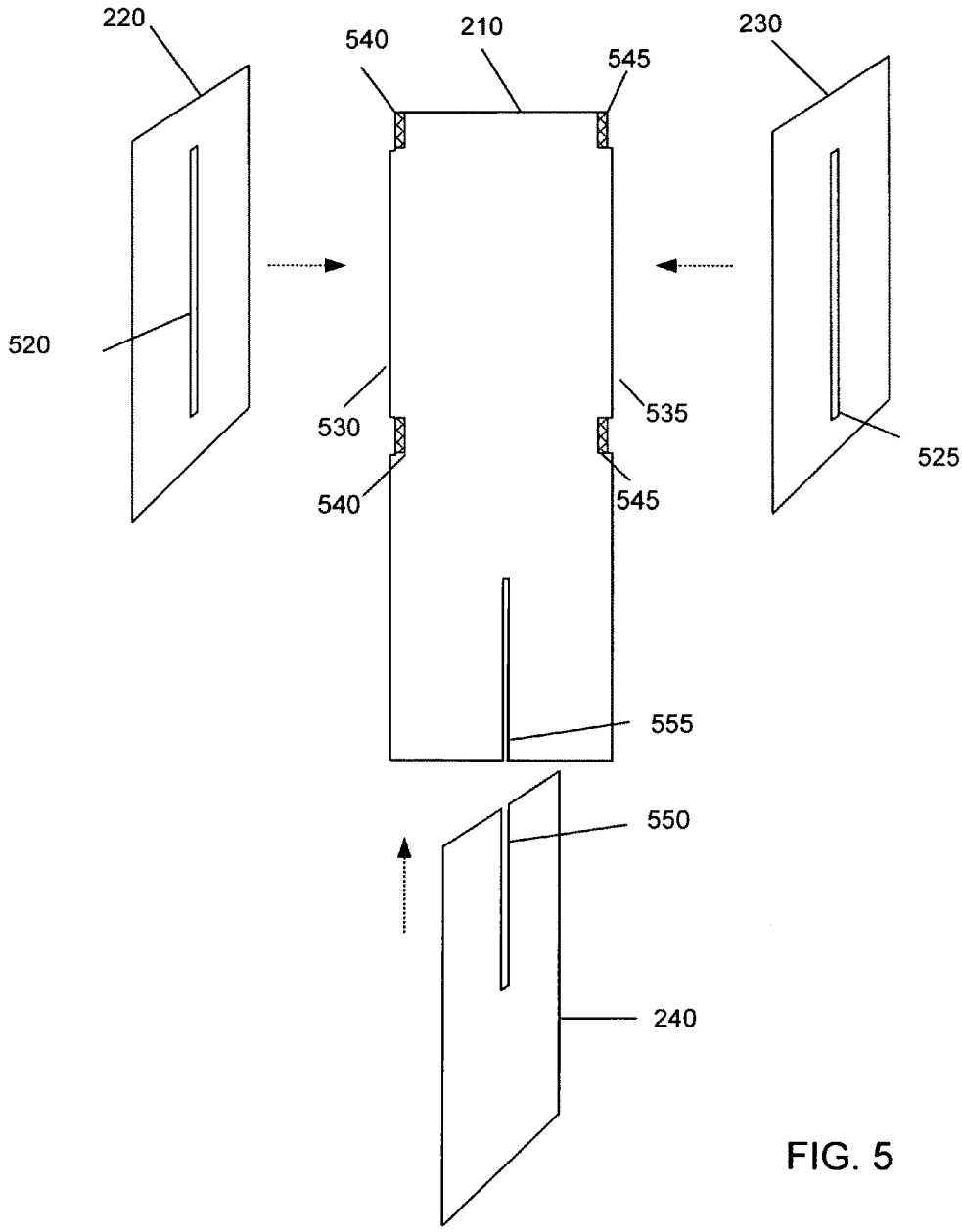
FIG. 5 illustrates an exploded view to show a method of manufacture of the antenna apparatus of FIG. 3, in one embodiment in accordance with the present invention.

FIG. 5 illustrates an exploded view to show a method of manufacture of the antenna apparatus 110 of FIG. 3, in one embodiment in accordance with the present invention. In this embodiment, the substrates 210-240 are first formed from a single PCB. The PCB may comprise a part of a large panel upon which many copies of the substrates 210-240 are formed. After being partitioned from the PCB, the substrates 210-240 are oriented and affixed to each other.

An aperture (slit) 520 of the substrate 220 is approximately the same width as the thickness of the substrate 210. The slit 520 is aligned to and slid over a tab 530 included on the substrate 210. The substrate 220 is affixed to the substrate 210 with electronic solder to the solder pads 540. The solder pads 540 are oriented on the substrate 210 to electrically and/or mechanically bond the slot antenna of the substrate 220 to the coupling network and/or the ground components of the substrate 210.

Alternatively, the substrate 220 may be affixed to the substrate 210 with conductive glue (e.g., epoxy) or a combination of glue and solder at the interface between the substrates 210 and 220. However, affixing the substrate 220 to the substrate 210 with electronic solder at the solder pads 540 has the advantage of reducing manufacturing steps, since the electronic solder can provide both a mechanical bond and an electrical coupling between the slot antenna of the substrate 220 and the coupling network of the substrate 210.

In similar fashion to that just described, to affix the substrate 230 to the substrate 210, an aperture (slit) 525 of the substrate 230 is aligned to and slid over a tab 535 included on the substrate 210. The substrate 230 is affixed to the substrate 210 with electronic solder to solder pads 545, conductive glue, or a combination of glue and solder.

To affix the substrate 240 to the substrate 210, a mechanical slit 550 of the substrate 240 is aligned with and slid over a corresponding slit 555 of the substrate 210. Solder pads (not shown) on the substrate 210 and the substrate 240 electrically and/or mechanically bond the dipoles of the substrate 240 to the coupling network and/or the ground components of the substrate 210.

Figure 6:
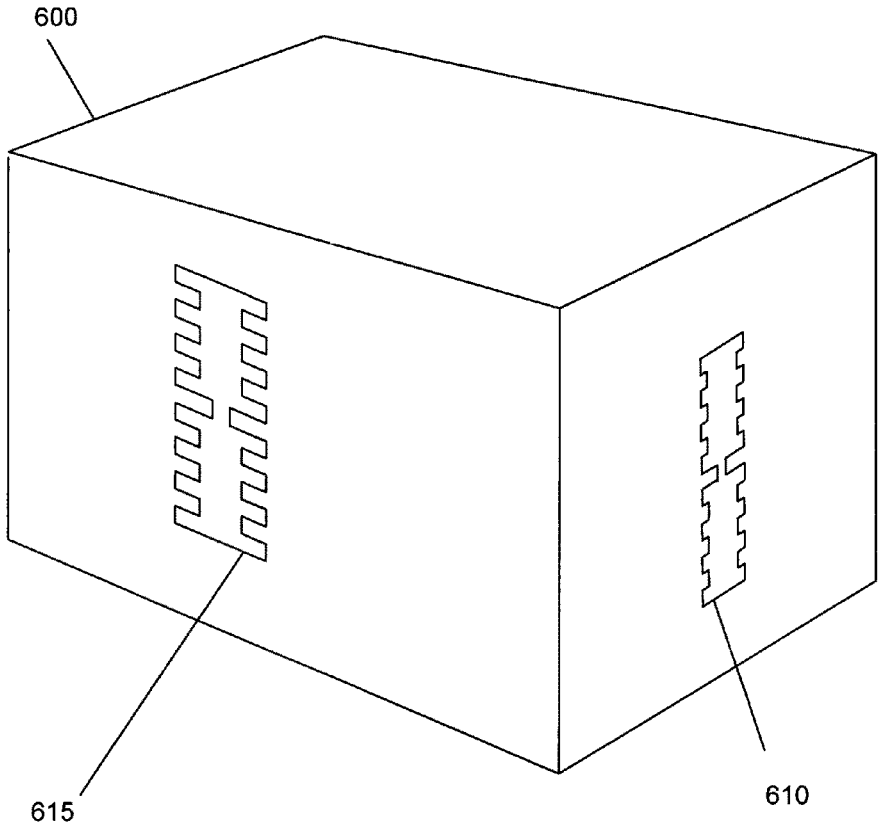
FIG. 6 illustrates an alternative embodiment for the slots of the antenna apparatus in a housing of the system of FIG. 1.

FIG. 6 illustrates an alternative embodiment for the slots of the antenna apparatus 110 in a housing 600 of the system 100 of FIG. 1. The housing 600 incorporates the antenna apparatus 110 by including a number of slot antennas 610 and 615 (only two slots depicted for clarity) on one or more faces of the housing 600. The dipoles depicted in FIG. 3 may be included internally to the housing 600 (e.g., for a plastic housing), provided externally to the housing 600 (e.g., for a metal or other RF-conductive housing), or not included in the antenna apparatus 110.

The slots 610 and 615 include fingers for reducing the overall size of the slots, as described herein. The slots 610 and 615 may be oriented in the same or different directions. In some embodiments, the housing 600 comprises a metallic or otherwise conductive housing 600 for the system 100, and one or more of the slots 610 and 615 are integral with, and formed from, the housing 600. For example, the housing 600 may be formed from metal such as stamped steel, aluminum, or other RF conducting material.

The slots 610 and 615 may be formed from, and therefore coplanar with, the housing 600. To prevent damage from foreign matter entering the openings in the housing 600 formed by the slots, the slots may be covered with non-conductive material such as plastic. In alternative embodiments, one or more of the slots 610 and 615 may be separately formed (e.g., of PCB traces or conductive foil) and conformally-mounted to the housing 600 of the system 100, for example if the housing 600 is made of non-conductive material such as plastic.

Although FIG. 6 depicts two slots 610 and 615, one or more slots may be formed on one or more sides of the housing. For example, with a 6-sided housing (top, bottom, and four sides), four slots may be included in the housing, one slot on each of the vertical sides of the housing other than the top and bottom. The slots may be oriented in the same or different directions, depending on the desired radiation pattern.

For the embodiment of FIG. 6 in which the antenna apparatus 110 incorporates slots on the housing 600, the antenna element selector (FIG. 3) may comprise a separate structure (not shown) from the slots 610 and 615. The antenna element selector may be mounted on a relatively small PCB, and the PCB may be electrically coupled to the slots 610 and 615, for example by RF coaxial cables.

OTHER EMBODIMENTS

Although not depicted, the system 100 of FIG. 1 may include multiple parallel communication devices 120 coupled to the antenna apparatus 110, for example in a multiple input multiple output (MIMO) architecture such as that disclosed in co-pending U.S. application Ser. No. 11/190,288 titled "Wireless System Having Multiple Antennas and Multiple Radios" filed Jul. 26, 2005. For example, the horizontally polarized slots of the antenna apparatus 110 may be coupled to a first of the communication devices 120 to provide selectable directional radiation patterns with horizontal polarization, and the vertically polarized dipoles may be coupled to the second of the communication devices 120 to provide selectable directional radiation patterns with vertical polarization. The antenna feed port 340 and associated coupling network of FIG. 3A may be modified to couple the first and second communication devices 120 to the appropriate antenna elements of the antenna apparatus 110. In this fashion, the system 100 may be configured to provide a MIMO capable system with a combination of directional to omnidirectional coverage as well as horizontal and/or vertical polarization.

In other alternative embodiments, the antenna elements of the antenna apparatus 110 may be of varying dimension, for operation at different operating frequencies and/or bandwidths. For example, with two radio frequency feed ports 340 (FIG. 3) and two communications devices 120 (FIG. 1), the antenna apparatus 110 may provide operation at two center frequencies and/or operating bandwidths.

In some embodiments, to further minimize or reduce the size of the antenna apparatus 110, the dipoles may optionally incorporate one or more loading structures as are described in co-pending U.S. application Ser. No. 11/041,145 titled "System and Method for a Minimized Antenna Apparatus with Selectable Elements" filed Jan. 21, 2005. The loading structures are configured to slow down electrons, changing the resonance of the dipole, thereby making the dipole electrically shorter. At a given operating frequency, providing the loading structures allows the dimension of the dipole to be reduced.

In some embodiments, to further minimize or reduce the size of the antenna apparatus 110, the ½-wavelength slots depicted in FIG. 3 may be "truncated" in half to create ¼-wavelength modified slot antennas. The ¼-wavelength slots provide a different radiation pattern than the ½-wavelength slots.

A further variation is that the antenna apparatus 110 disclosed herein may incorporate the minimized antenna apparatus disclosed in U.S. application Ser. No. 11/041,145 wholly or in part. For example, the slot antennas described with respect to FIG. 3 may be replaced with the minimized antenna apparatus of U.S. application Ser. No. 11/041,145.

In alternate embodiments, although the antenna apparatus 110 is described as having four dipoles and three slots, more or fewer antenna elements are contemplated. Generally, as will be apparent to a person or ordinary skill upon review of the co-pending applications referenced herein, providing more antenna elements of a particular configuration (more dipoles, for example), yields a more configurable radiation pattern formed by the antenna apparatus 110.

An advantage of the foregoing is that in some embodiments the antenna elements of the antenna apparatus 110 may each be selectable and may be switched on or off to form various combined radiation patterns for the antenna apparatus 110. Further, the antenna apparatus 110 includes switching at RF as opposed to switching at baseband. Switching at RF means that the communication device 120 requires only one RF up/down converter. Switching at RF also requires a significantly simplified interface between the communication device 120 and the antenna apparatus 110. For example, the antenna apparatus 110 provides an impedance match under all configurations of selected antenna elements, regardless of which antenna elements are selected.

Another advantage is that the antenna apparatus 110 comprises a 3-dimensional manufactured structure of relatively low complexity that may be formed from inexpensive and readily available PCB material.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. The embodiments and preferred features described above should be considered exemplary, with the invention being defined by the appended claims, which therefore include all such alternatives, modifications, permutations and equivalents as fall within the true spirit and scope of the present invention.

What is claimed is:

1. A system for wireless communication, comprising:

a communication device configured to generate or receive a radio frequency (RF) signal;

a plurality of antenna elements including one or more selectable horizontally polarized antennas and one or more selectable vertically polarized antennas, each of the plurality of antenna elements configured to transmit or receive an RF signal with a remote node through a wireless link; and an antenna element selecting device configured to selectively couple a first combination of one or more of the plurality of antenna elements to the communication device, the antenna element selecting device further configured to selectively couple a second combination of one or more of the plurality of antenna elements to the communication device when the wireless link experiences interference.

2. The system of claim 1, wherein the plurality of antenna elements includes at least six antenna elements.

3. The system of claim 1, wherein the first combination of one or more of the plurality of antenna elements radiates an RF signal in a first direction and the second combination of one or more of the plurality of antenna elements radiates an RF signal in a second direction.

4. The system of claim 1, wherein the first combination of one or more of the plurality of antenna elements radiates an RF signal corresponding to a first gain and the second combination of one or more of the plurality of antenna elements radiates an RF signal corresponding to a second gain.

5. The system of claim 1, further comprising a housing, wherein the communication device, the plurality of antenna elements, and the antenna element selecting device are contained within the housing.

6. The system of claim 1 further comprising a plurality of light emitting diodes (LEDs), wherein different combinations of the plurality of LEDs are selected based on a selected combination of the plurality of antenna elements.

7. The system of claim 1 further comprising a light emitting diode (LED) associated with each antenna element, wherein the state of each LED indicates whether the associated antenna is selectively coupled to the communication device.

8. An apparatus for wireless communication, comprising:

a first printed circuit board including a plurality of elements for transmitting or receiving a radio frequency (RF) signal, the plurality of elements including a first element configured to transmit or receive an RF signal in a first polarization and a second element configured to transmit or receive an RF signal in a second polarization, the directional configuration of the first polarization differing from the directional configuration of the second polarization, the RF signal communicated to a remote node through a wireless link;

processing circuitry configured to process the RF signal; and an element selection device configured to couple one or more of the plurality of selected elements to the processing circuitry, the element selection device further configured to select different sets of elements within the plurality of elements based on interference in the wireless link.

9. The apparatus of claim 8, wherein the plurality of elements includes one or more selectable antenna elements.

10. The apparatus of claim 9, wherein the selectable antenna elements may be selected to form different combinations, each combination associated with a radiation pattern.

11. The apparatus of claim 10, wherein at least two of the combinations are associated with radiation patterns having a different direction.

12. The apparatus of claim 10, wherein at least two of the combinations of elements are associated with radiation patterns having a different gain.

13. The apparatus of claim 10, further comprising a plurality of light emitting diodes (LEDs), wherein different combinations of the LEDs are illuminated based on different combinations of the selectable antenna elements.

14. The apparatus of claim 8, wherein the plurality of elements, the processing circuitry, and the element selection device are contained within a housing.

15. An apparatus for wireless communication, comprising:

a first printed circuit board including a plurality of elements for transmitting or receiving a radio frequency (RF) signal, the plurality of elements including a first element configured to transmit or receive an RF signal in a first polarization and a second element configured to transmit or receive an RF signal in a second polarization, the directional configuration of the first polarization differing from the directional configuration of the second polarization, the RF signal communicated to a remote node through a wireless link, wherein the plurality of elements are incorporated on the printed circuit board;

processing circuitry configured to process the RF signal; and an element selection device configured to couple one or more of the plurality of selected elements to the processing circuitry, the element selection device further configured to select different sets of elements within the plurality of elements based on interference in the wireless link.

16. An apparatus for wireless communication, comprising:

a first printed circuit board including a plurality of elements for transmitting or receiving a radio frequency (RF) signal, the plurality of elements including a first element configured to transmit or receive an RF signal in a first polarization and a second element configured to transmit or receive an RF signal in a second polarization, the directional configuration of the first polarization differing from the directional configuration of the second polarization, the RF signal communicated to a remote node through a wireless link;

processing circuitry configured to process the RF signal; and an element selection device configured to couple one or more of the plurality of selected elements to the processing circuitry, the element selection device further configured to select different sets of elements within the plurality of elements based on interference in the wireless link, wherein all of the plurality of elements are selectable.

17. A system for wireless communication, comprising:

a plurality of antenna elements including one or more selectable horizontally polarized antennas and one or more selectable vertically polarized antennas, each of the plurality of antennas configured to transmit or receive a radio frequency (RF) signal with a remote node through a wireless link;

interference detection circuitry for detecting interference in the wireless link; and an antenna element selecting device configured to select a first combination of one or more of the plurality of antenna elements to transmit or receive an RF signal, the antenna element selecting device further configured to select a second combination of one or more of the plurality of antenna elements to transmit or receive an RF signal when the interference detection circuitry detects wireless link interference.

18. A system for wireless communication, comprising:

a plurality of antenna elements including one or more selectable horizontally polarized antennas and one or more selectable vertically polarized antennas, each of the plurality of antennas configured to transmit or receive a radio frequency (RF) signal with a remote node through a wireless link;

interference detection circuitry for detecting interference in the wireless link; and an antenna element selecting device configured to select a first combination of one or more of the plurality of antenna elements to transmit or receive an RF signal, the antenna element selecting device further configured to select a second combination of one or more of the plurality of antenna elements to transmit or receive an RF signal when the interference detection circuitry detects wireless link interference, wherein the plurality of antenna elements, the antenna element selecting device and the interference detection circuitry are incorporated on a printed circuit board, the printed circuit board coupled to a housing.

* * * * *